US005761570A

United States Patent [19]

Sawayama et al.

[11] Patent Number: 5,761,570

[45] Date of Patent: *Jun. 2, 1998

[54] COLOR TONER DENSITY SENSOR AND IMAGE FORMING APPARATUS USING THE SAME

[75] Inventors: Noboru Sawayama; Kouta Fujimori, both of Tokyo, Japan

[73] Assignee: Ricoh Company, Ltd., Tokyo, Japan

[ * ] Notice: The term of this patent shall not extend beyond the expiration date of Pat. No. 5,630,195.

[21] Appl. No.: 815,733

[22] Filed: Mar. 12, 1997

Related U.S. Application Data

[63] Continuation of Ser. No. 584,443, Jan. 11, 1996, Pat. No. 5,630,195.

[30] Foreign Application Priority Data

May 12, 1995 [JP] Japan ..... 7-114480
Dec. 28, 1995 [JP] Japan ..... 7-342647

[51] Int. Cl.[6] ..... G03G 15/00

[52] U.S. Cl. ..... 399/49

[58] Field of Search ..... 399/49, 60, 64, 399/74; 118/692, 688, 691

[56] References Cited

U.S. PATENT DOCUMENTS 5,157,440 10/1992 Sawayama ..... 399/74
5,270,784 12/1993 Nakane et al. ..... 399/49
5,296,895 3/1994 Naito ..... 399/49
5,630,195 5/1997 Sawayama et al. ..... 399/49

*Primary Examiner*—S. Lee
*Attorney, Agent, or Firm*—Oblon, Spivak, McClelland, Maier & Neustadt, P.C.

[57] ABSTRACT

An image forming apparatus and method in which an image forming condition is controlled based on an output of a toner density sensor including a light emitting element that emits light toward a toner pattern image formed on an image carrier, and a light receiving element which receives light reflected from the toner image pattern to produce an output used to control an image forming condition of the image forming apparatus, wherein the light emitting element and the light receiving element are positioned such that a line connecting the light emitting element and the toner pattern image and a line connecting the light receiving element and the toner pattern image lie in a plane inclined at a predetermined angle relative to a normal extending from a surface of the image carrier.

14 Claims, 15 Drawing Sheets

$\phi_1 + \phi_2$
43
42
44
-90
-60
-30
-10
0
10
30
60
90
ANGLE ψ BETWEEN NORMAL OF IMAGE CARRIER & AXIS-CONTAINING PLANE (DEGREES)
OUTPUT VOLTAGE OF LIGHT RECEIVING ELEMENT

COLOR TONER DENSITY SENSOR AND IMAGE FORMING APPARATUS USING THE SAME

This is a Continuation of application Ser. No. 08/584,443 filed on Jan. 11, 1996, U.S. Pat. No. 5,630,195.

BACKGROUND OF THE INVENTION

The present invention relates to a sensor for sensing the density of a color toner deposited on an image carrier with a light emitting element and a light receiving element, and a color copier or similar image forming apparatus using the same.

A copier, printer or similar image forming apparatus develops a latent image formed on the surface of a photoconductive element or image carrier by use of a developer stored in a developing unit and containing a toner. Because the toner is sequentially consumed due to repeated development, a fresh toner must be replenished into the developer in order to maintain the density of images constant. For this purpose, it has been customary to locate a reference chart having a preselected density in the vicinity of a glass platen to be loaded with a document. A reference pattern representative of the reference chart is formed on the image carrier by exposure and development. The density of the reference pattern is optically sensed in order to control the replenishment of the toner. This control scheme stems from the fact that the toner concentration of the developer varies in proportion to the developing density, i.e., the amount of toner deposited on the image carrier. Specifically, the sensed density of the reference pattern is compared with the preselected density. If the sensed density is higher than the preselected density, the replenishment is interrupted or reduced in amount. If the former is lower than the latter, the replenishment is resumed or increased in amount.

A red, blue or similar monocolor copier is available today. This kind of copier is operable with developing units respectively storing a black toner and a color toner and replaceable with each other, or with such developing units fixedly arranged side by side and selectively used, or with a full-color developing unit.

As for the black toner, it is a common practice to sense the density of the reference pattern by use of optical sensing means made up of a light emitting element and a light receiving element. A plane containing the optical axes of the light emitting and light receiving elements is coincident with a plane containing a normal extending from the image carrier. Hence, the light receiving element senses a regular reflection from the light emitting element. However, the color toner diffuses light incident thereto. Hence, the image carrier and color toner differ little in reflectance from each other. This makes it impossible to set up a correlation between the density of the color toner and the output voltage of the light receiving element, i.e., the quantity of diffused reflection. Consequently, it is difficult to sense the density of the reference pattern formed by the color toner.

In light of the above, Japanese Patent Laid-Open Publication No. 61-209470 discloses a toner density sensor in which at least one of the light emitting element and light receiving elements is rotatable in the plane containing their optical axes. In this sensor, the light receiving element receives the regular reflection in the event of development using the black toner, or receives the diffused reflection in the event of development using the color toner. Japanese Patent Laid-Open Publication No. 62-164066 teaches a replenishment control method using an infrared photosensor whose output characteristic resembles a curve of secondary degree. As for the monocolor toner, the method effects control in a color characteristic range in which the output of the photosensor increases with an increase in image density, and limits the replenishment when the sensor output rises above a preselected value. Further, Japanese Patent Laid-Open Publication No. 62-209476 proposes a method using two light receiving elements which are respectively assigned to the regular reflection and diffused reflection, so that the replenishment can be controlled on the basis of a difference between their outputs.

However, the prior art color density sensing methods and devices stated above have some problems left unsolved, as follows. The plane containing the axis of the image carrier and the axes of the light emitting and light receiving elements is coincident with the plane containing the normal of the image carrier. The angles of the light emitting and light receiving elements are varied within the above plane. In this condition, the reflection from a color toner image formed on the image carrier is a diffused reflection, and is therefore extremely small in quantity. To sufficiently sense such a reflection, it is necessary that the two elements be positioned close to the image carrier (surface to be sensed), or that their light emitting surface and light receiving surface be increased in size. This kind of approach, however, causes much of the regular reflection from the toner image to be incident to the light receiving element together with the diffused reflection, preventing the toner density from being accurately sensed. In addition, the above approach makes it necessary to assemble the mechanism in a limited space, and complicates the construction of the apparatus.

SUMMARY OF THE INVENTION

It is therefore an object of the present invention to provide a simple color toner density sensor capable of optically using the amount of color toner (surface density) deposited on an image carrier with high accuracy, particularly in a portion where the toner fully covers the surface of the image carrier, and an image forming apparatus using the same.

In accordance with the present invention, in an image forming apparatus having a toner density sensor for emitting light from a light emitting element toward a toner pattern image formed on an image carrier, and receiving the resulting reflection from the toner pattern image with a light receiving element in order to allow an image forming condition to be controlled on the basis of the output thereof, the light emitting element and light receiving element each has a directivity. The optical axes of the light emitting and light receiving elements intersect each other at a point exiting on or in the vicinity of the surface of the image carrier. The light emitting and light receiving elements are positioned such that a plane containing the optical axis is inclined a predetermined angle relative to a normal extending from the surface of the image carrier through the above point.

Also, in accordance with the present invention, in a toner density sensor for emitting light from a light emitting element toward a toner pattern image formed on an image carrier, and receiving the resulting reflection from the toner pattern image with a light receiving element, the light emitting and light receiving elements each has a directivity. The optical axes of the light emitting and light receiving elements intersect each other at a point exiting on or in the vicinity of the surface of the image carrier. The light emitting and light receiving elements are positioned such that a plane containing the optical axes is inclined a predetermined angle relative to a normal extending from the surface of the image carrier through the above point.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 19:
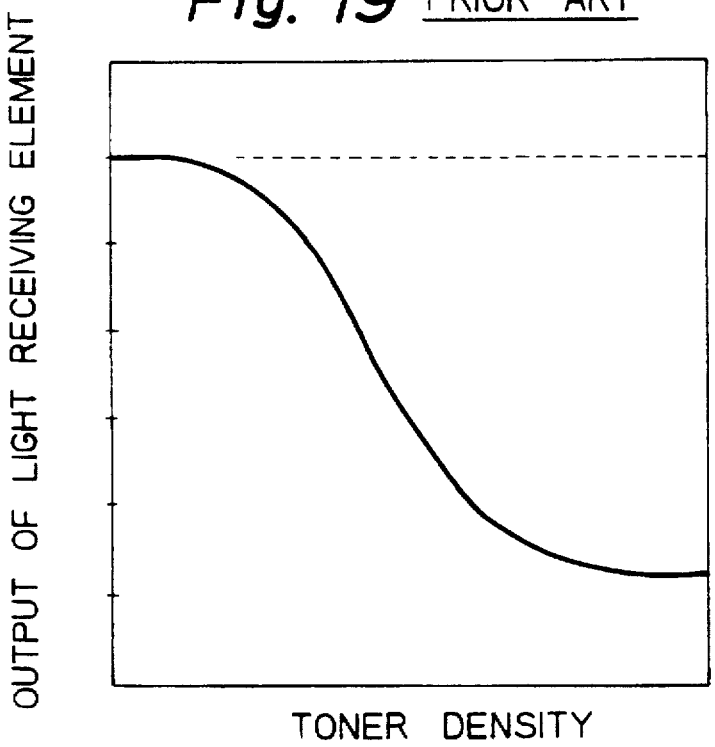
Fig. 19 PRIOR ART
FIG. 19 shows a relation between the output voltage of a conventional light receiving element and the amount of toner deposition on an image carrier.

In a copier using a black toner, a toner replenishment control device has optical means for sensing the density of a reference pattern and implemented by a light emitting element and a light receiving element. The optical means is so configured as to cause a regular reflection from an image carrier to be incident to the light receiving element. A plane containing the optical axes of the two elements is coincident with a plane containing a normal extending from the image carrier. However, a color toner diffuses light incident thereto, as stated earlier. Hence, the image carrier and color toner differ little in reflectance from each other. This makes it impossible to set up a correlation between the density of the color toner and the output voltage of the light receiving element, i.e., the quantity of diffused reflection, as shown in FIG. 19. Consequently, it is difficult to sense the density of the reference pattern formed by the color toner. In FIG. 19, a dotted curve and a solid curve are respectively derived from a color toner and a black toner. While Japanese Patent Laid-Open Publication Nos. 61-209470, 62-164066 and 62-209476 propose various implementations for solving the above problem, they are not fully acceptable, as discussed earlier.

Preferred embodiments of the present invention which eliminate the above problems will be described hereinafter.

Figure 1:
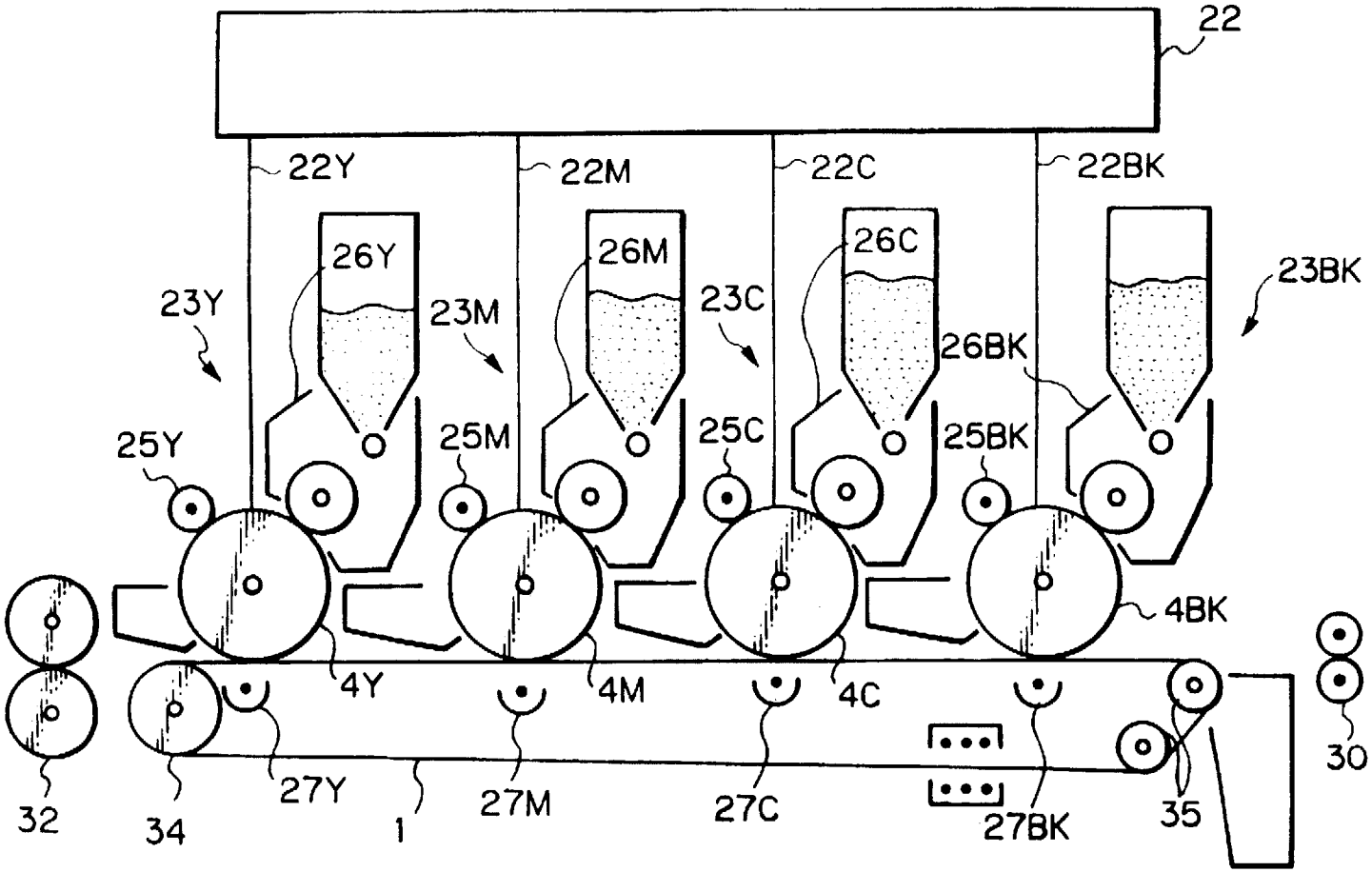
FIG. 1 is a section showing a color image forming apparatus to which the present invention is applicable.

Referring to FIG. 1, a color image forming apparatus to which the present invention is applied is shown. As shown, the apparatus has a writing unit 22 to which digital image data are fed from a scanner, not shown. Recording units 23Y (Yellow), 23M (Magenta), 23C (Cyan) and 23BK (Black) are arranged in a single plane at predetermined intervals. The writing unit 22 emits laser beams 22Y, 22M, 22C and 22BK each containing the respective color image data toward the recording units 23Y–23BK. Although the recording units 23Y–23BK are different in developing color, they have an identical configuration for electrophotography. The recording unit 23C, for example, has a photoconductive drum 4C, a charger 25C, and a developing unit 26C. The charger 25C uniformly charges the surface of the drum 4C to a potential corresponding to a certain tone. The laser beam 22C from the writing unit 22 scans the charged surface of the drum 4C. As a result, a latent image representative of an optical cyan image is formed on the drum 4C. The developing unit 26C develops the latent image and thereby produces a corresponding cyan toner image.

An image transfer belt 1 is passed over a drive roller 34 and driven rollers 35. A paper fed from a paper feed section, not shown, is driven onto the belt 1 by a registration roller pair 30 at a predetermined timing. While the belt 1 conveys the paper from the right to the left as viewed in FIG. 1, toner images formed on drums 4BK, 4C, 4M and 4Y in the above-described manner are sequentially transferred to the paper one upon the other. The resulting composite color image is fixed on the paper by a fixing roller pair 32. The paper with the fixed color image is driven out of the apparatus as a copy.

Figure 2:
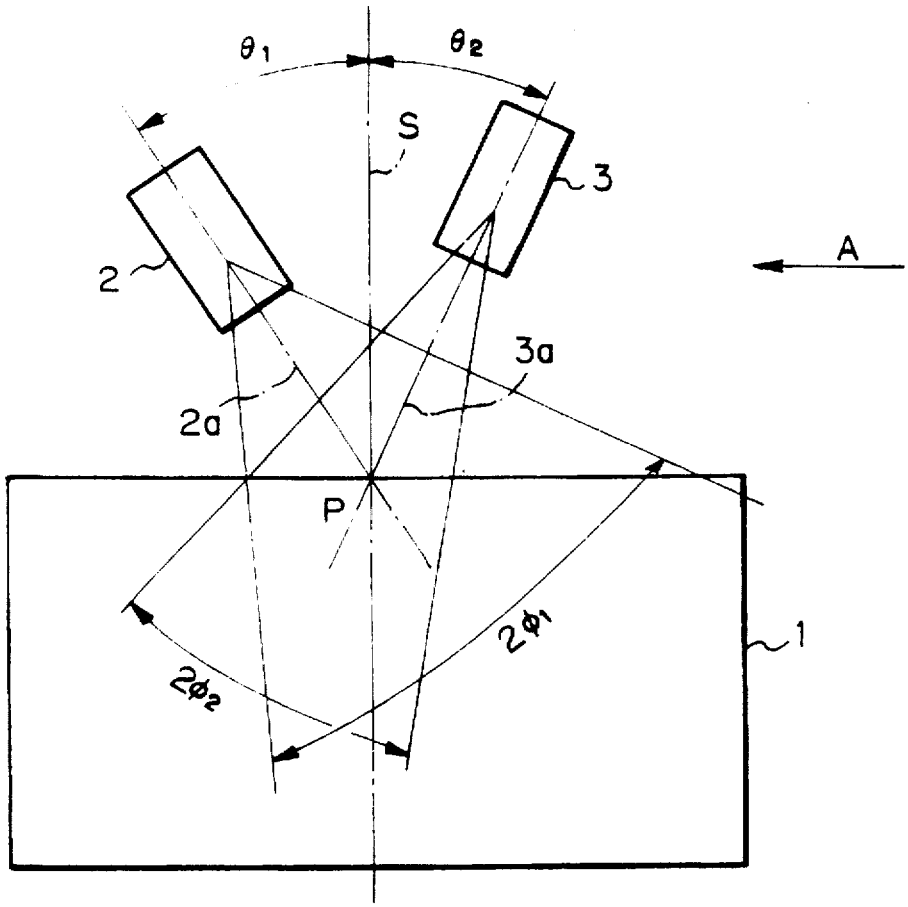
FIG. 2 is a view of a light emitting element and a light receiving element constituting a first embodiment of the color toner density sensor in accordance with the present invention, as seen from the front of an image carrier.

FIG. 2 shows a first embodiment of the color toner density sensor in accordance with the present invention. As shown, the sensor has a light emitting element 2 and a light receiving element 3 having optical axes 2*a* and 3*a*, respectively. Labeled s is a vertical extending through a preselected point P on the belt 1. The elements 2 and 3 are positioned such that their optical axes 2*a* and 3*a* are respectively inclined by angles $\theta_1$ and $\theta_2$ relative to the vertical s. In the illustrative embodiment, the elements 2 and 3 each has a relatively broad directivity. Specifically, the angle $\phi 1$ at which the quantity of light issuing from the element 2 is halved is 30 degrees, while the angle $\phi 2$ at which the sensitivity of the light-sensitive range of the element 3 is halved is 20 degrees. It is to be noted that the angles $\phi 1$ and $\phi 2$ are each representative of the spread angle of the respective element 2 or 3.

Figure 3:
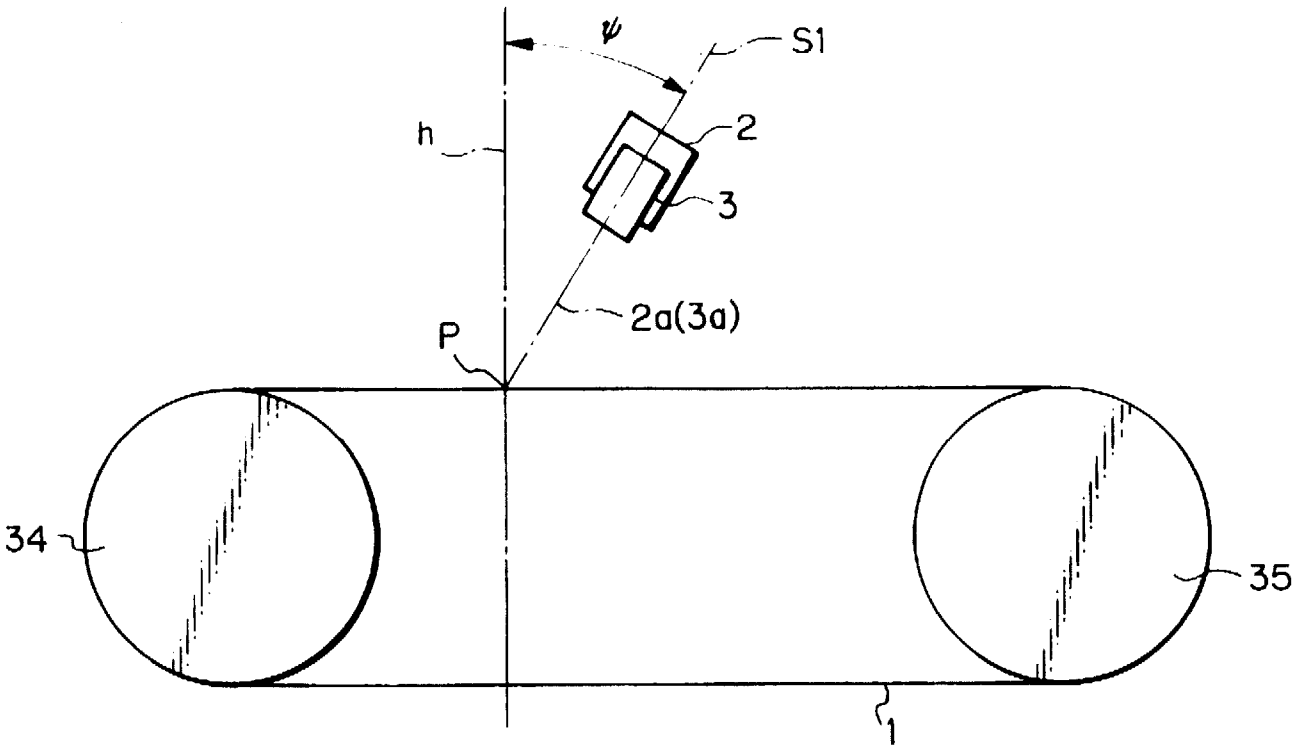
FIG. 3 is a view of the embodiment as seen in a direction indicated by an arrow A in FIG. 2.

The word "directivity" of the individual element 2 or 3 refers to a light distribution range in which the intensity of emitted light or the sensitivity to received light is halved. FIG. 3 is a view as seen in the direction indicated by an arrow A in FIG. 2. As shown, the elements 2 and 3 are positioned such that a normal h extending from the point P on the belt 1 and a plane S1 containing the optical axes 2*a* and 3*a* make an angle $\phi$ therebetween. In this embodiment, the angle $\phi$ is selected to be 30 degrees.

Figure 4:
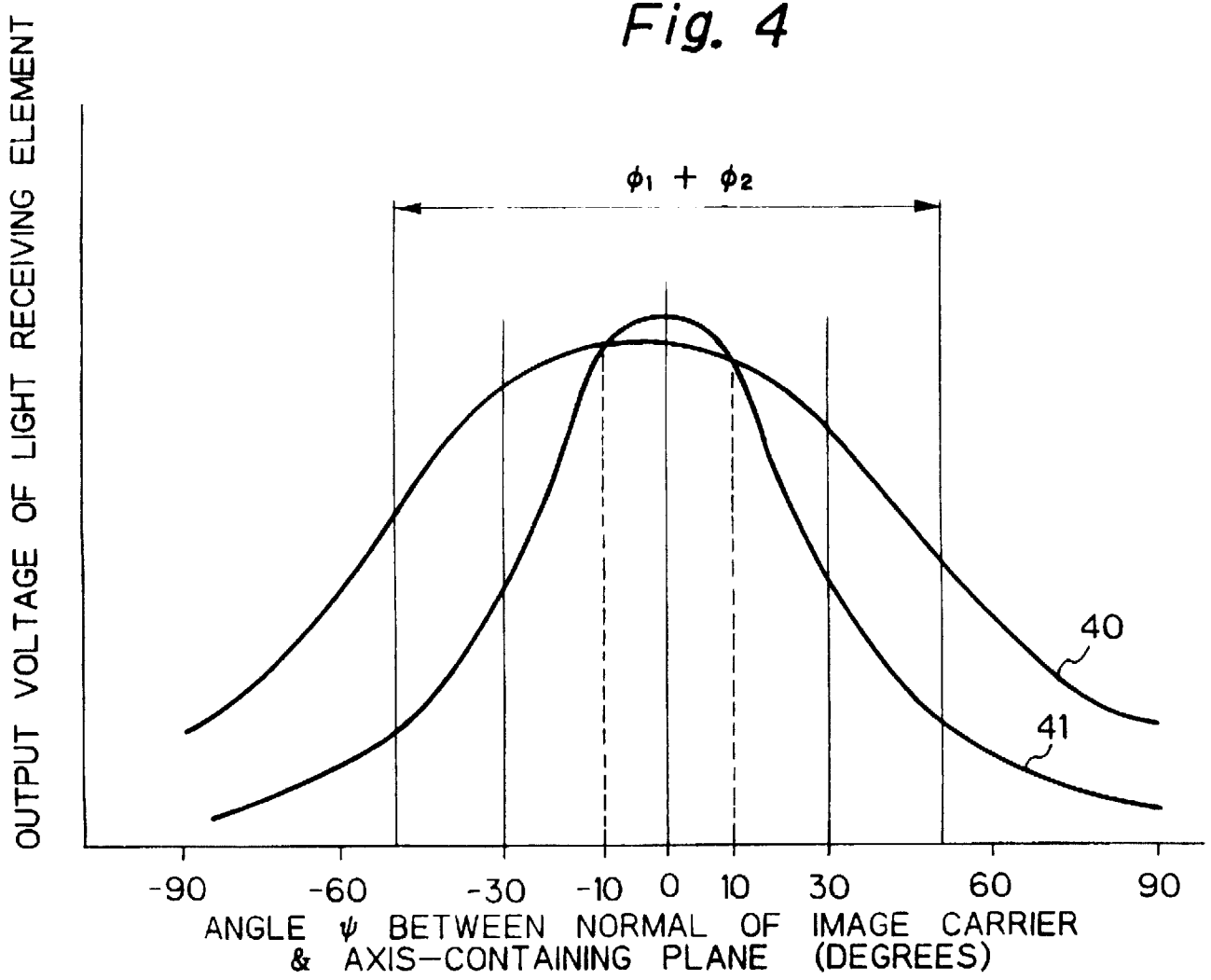
FIG. 4 is a graph indicative of a relation between the output voltage of the light receiving element and the angle of a plane containing the optical axes of the light emitting and light receiving elements to a normal, and appearing when the two elements each has a relatively broad directivity.

When the angle $\phi$ between the normal h and the plane S1 is varied, the output voltage of the element 3 sequentially varies as shown in FIG. 4. Curves 40 and 41 shown in FIG. 4 were respectively derived when the belt 1 was fully covered with a color toner and when it was free from the toner. As shown, when the angle $\phi$ lies in the range of from −10 degrees to 10 degrees, the output of the element 3 differs little from the case wherein the belt 1 is fully covered with a color toner to the case wherein it is free from the toner, because of diffused reflection particular to the color toner. As a result, the sensitivity to the toner density is low. By contrast, at the outside of the above range, the variation in the output of the element 3, i.e., the difference between the two characteristic curves 41 and 42 is most noticeable. In light of this, in the embodiment, the plane containing the axes 2*a* and 2*b* of the elements 2 and 3 is so inclined as to make the angle $\phi$ greater than 10 degrees or smaller than −10 degrees. This successfully increases the difference in the output of the element 3 between the above two conditions and thereby enhances the accurate sensing of toner density.

The directivity, i.e., spread angle of the element 2 and that of the element 3 involve some error ascribable to a production line. Therefore, in the actual design, the angle $\phi$ should preferably be greater than or equal to 25 degrees in absolute value, i.e.:

$$\left|\frac{\phi 1+\phi 2}{2}\right| = 25^\circ \leqq |\phi|$$

Because the embodiment selects the angle $\phi$ of 30 degrees, it is free from the influence of the irregularity in the configurations of the elements 2 and 3 and achieves high sensitivity to toner density.

A reference will be made to FIGS. 5–9 for describing a second embodiment of the sensor in accordance with the present invention. In the first embodiment, the image carrier is implemented as the belt 1, and the elements 2 and 3 each has a relatively broad directivity. In the second embodiment, use is made of an image carrier implemented as a photoconductive drum, and a light emitting element and a light receiving element each having a medium directivity.

Figure 6:
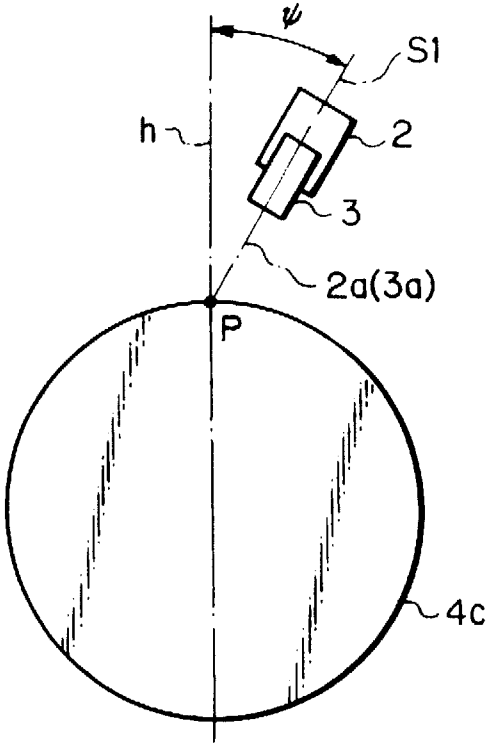
FIG. 6 is a view as seen in the direction indicated by an arrow A in FIG. 5.
Figure 5:
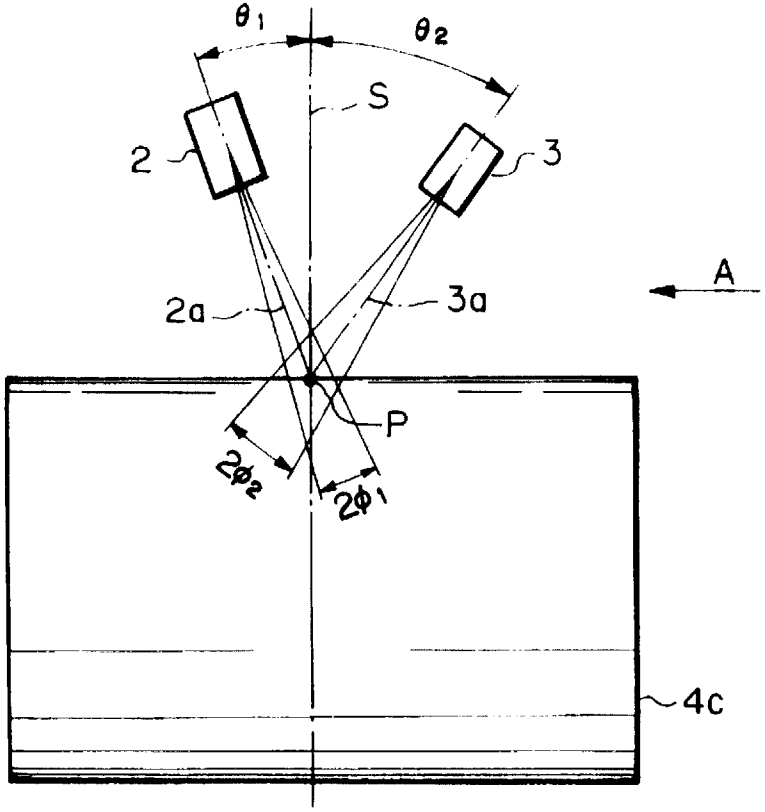
FIG. 5 shows a light emitting element and a light receiving element constituting a second embodiment of the present invention.

As shown in FIG. 5, a normal s extends through a predetermined point P on the drum 4C (or 4BK, 4M or 4Y shown in FIG. 1). The elements 2 and 3 are positioned such that their optical axes 2*a* and 3*a* are respectively inclined by the angles $\theta 1$ and $\theta 2$ relative to the normal s. In this embodiment, the elements 2 and 3 each has a medium directivity as to the spread of emitted or received light. Specifically, the angle $\phi 1$ at which the quantity of light to issue from the elements 2 is halved selected to be 8 degrees, while the angle $\phi 2$ at which the sensitivity of the element 3 to the incident light is halved is selected to be 12 degrees. FIG. 6 is a view as seen in the direction indicated by an arrow A in FIG. 5. As shown, the elements 2 and 3 are positioned such that a normal h extending through the point P on the drum 4C and a plane S1 containing the optical axes 2*a* and 3*a* make an angle $\phi$ therebetween.

Figure 7:
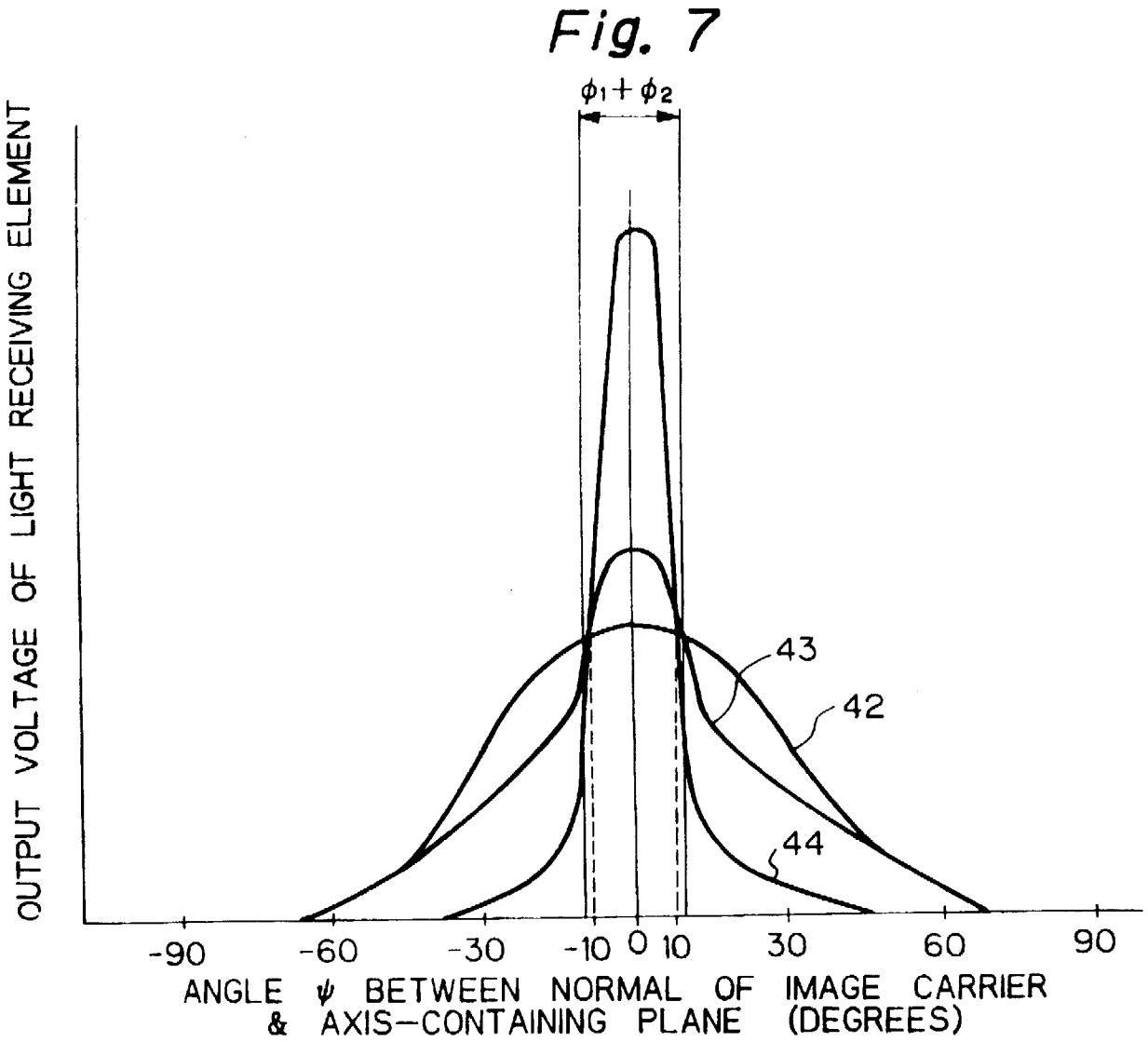
FIG. 7 is a graph indicative of a relation between the output voltage of the light receiving element and the angle of a plane containing the optical axes of the light emitting and light receiving elements to a normal, and appearing when the two elements have medium directivities.
Figure 8:
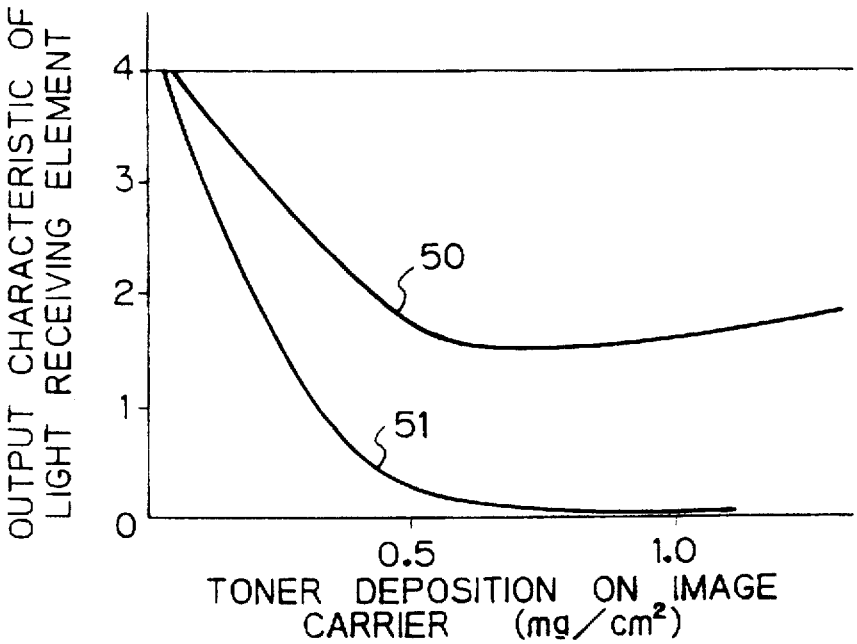
FIG. 8 shows a relation between the amount of toner deposition on the image carrier and the output voltage of the light receiving element.
Figure 9:
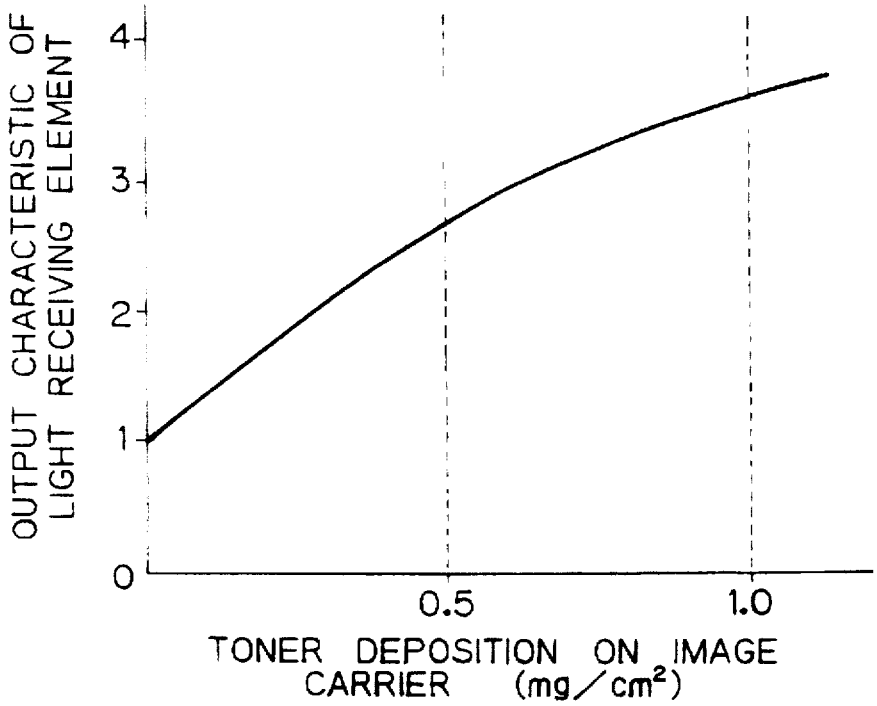
FIG. 9 shows a relation between the amount of toner deposition on the image carrier and the output voltage of the light receiving element, and determined by inclining the plane containing the optical axes of the two elements by an angle $\phi$ to the normal.

When the above angle $\phi$ is varied, the output voltage of the element 3 varies as shown in FIG. 7. When the angle $\phi$ is zero degree, the output voltage of the element 3 varies in relation to the amount of toner deposited on the drum 4C, as shown in FIG. 8. In FIG. 7, curves 42, 43 and 44 were respectively derived when the drum 4C was fully covered with a color toner, when it carried some color toner thereon, and when it was free from the color toner. As shown, at and around the angle $\phi$ of zero degree, the output voltage of the element 3 noticeably differs from one condition to another condition without regard to the degree of toner deposition. However, as shown in FIG. 8, when the angle $\phi$ is zero degree, from the point where the amount of toner deposition exceeds 0.5 mg/cm$^2$ and onward, the output voltage of the element 3 differs little despite changes in the amount of toner deposition. By contrast, when angle $\phi$ is selected to be 10 degrees, the output voltage of the element 3 noticeably varies in relation to the amount of toner deposition, as shown in FIG. 9. Hence, if the angle $\phi$ is greater than 10 degrees or smaller than −10 degrees, the difference between the above output characteristics as to the output voltage of the element 3 is rendered noticeable. This allows the device to sense the amount of color toner deposition with high sensitivity. In the illustrative embodiment, the angle $\phi$ is selected to be 30 degrees.

A third embodiment of the present invention will be described with reference to FIGS. 10–12. In the first and second embodiments, the point where the optical axes 2*a* and 3*a* of the elements 2 and 3 intersect each other is located on the surface of the image carrier. In the embodiment to be described, the axes 2*a* and 3*a* join each other at a point P' inboard of, i.e., adjacent to the surface of the image carrier.

Figure 10:
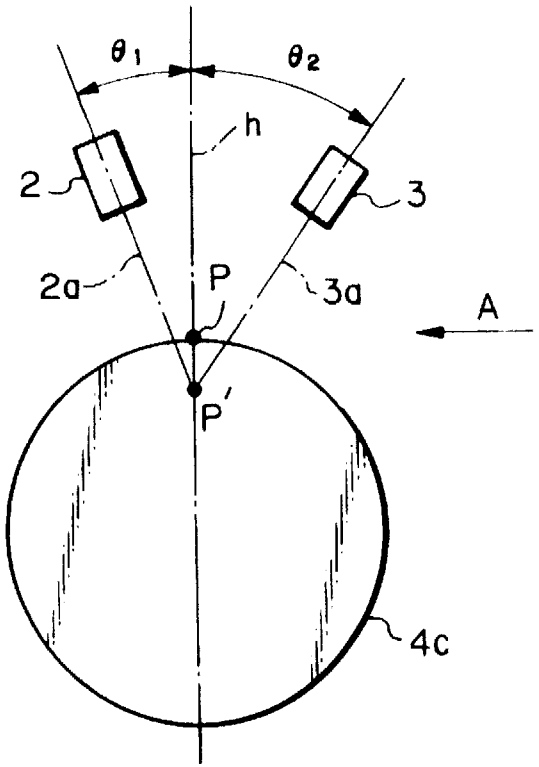
FIG. 10 shows a light emitting element and a light receiving element constituting a third embodiment of the present invention.

As shown in FIG. 10, the point P' is located on the normal h of the drum 4C and inboard of the surface of the drum 4C. The elements 2 and 3 are positioned such that their axes 2*a* and 3*a* are respectively inclined by the angles $\theta 1$ and $\theta 2$ to the normal h. In this embodiment, the elements 2 and 3 each has a relatively narrow directivity. Specifically, the angle $\phi 1$ at which the quantity of light to issue from the element 2 is halved is selected to be 8 degrees, while the angle $\phi 2$ at which the sensitivity of the element 3 to incident light is halved is selected to be 12 degrees.

Figure 11:
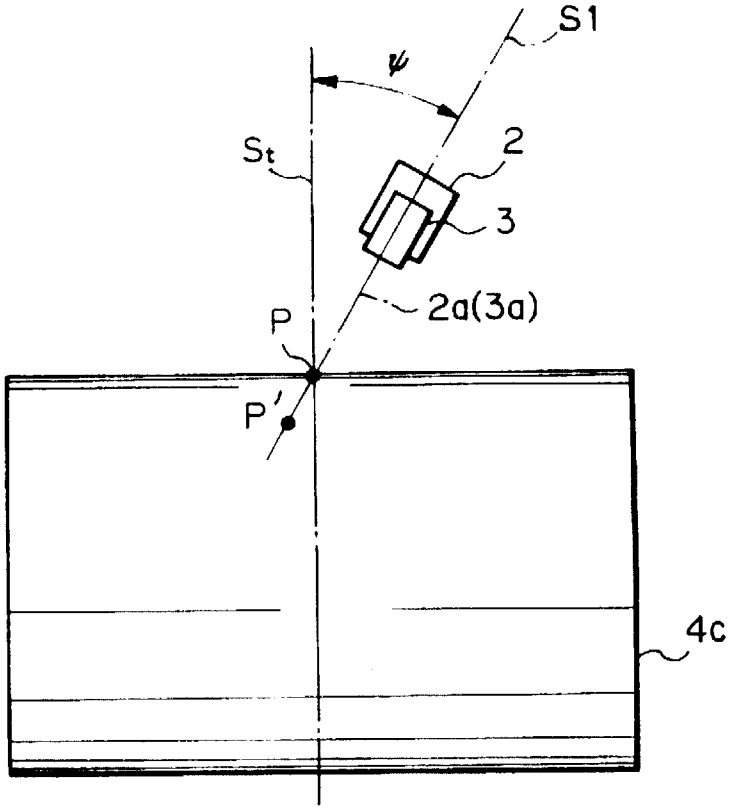
FIG. 11 shows a condition wherein a plane containing the optical axes of the two elements of the third embodiment is inclined by an angle $\phi$ to the normal.

FIG. 11 is a view as seen in the direction indicated by an arrow A in FIG. 10. As shown, the elements 2 and 3 are positioned such that a plane St perpendicular to the axis of the drum 4C (i.e. a plane containing the normal extending through the point P') and a plane S containing the optical axes 2*a* and 3*a* make an angle $\phi$ of 30 degrees therebetween. Even with this configuration, the device consisting of the elements 2 and 3 can accurately sense a diffused reflection from the color toner. This will be described specifically with reference to FIG. 12 in which the elements 2 and 3 inclined relative to the normal h are assumed to be positioned symmetrically to each other with respect to the image forming surface of the image carrier which is to be sensed.

Figure 12:
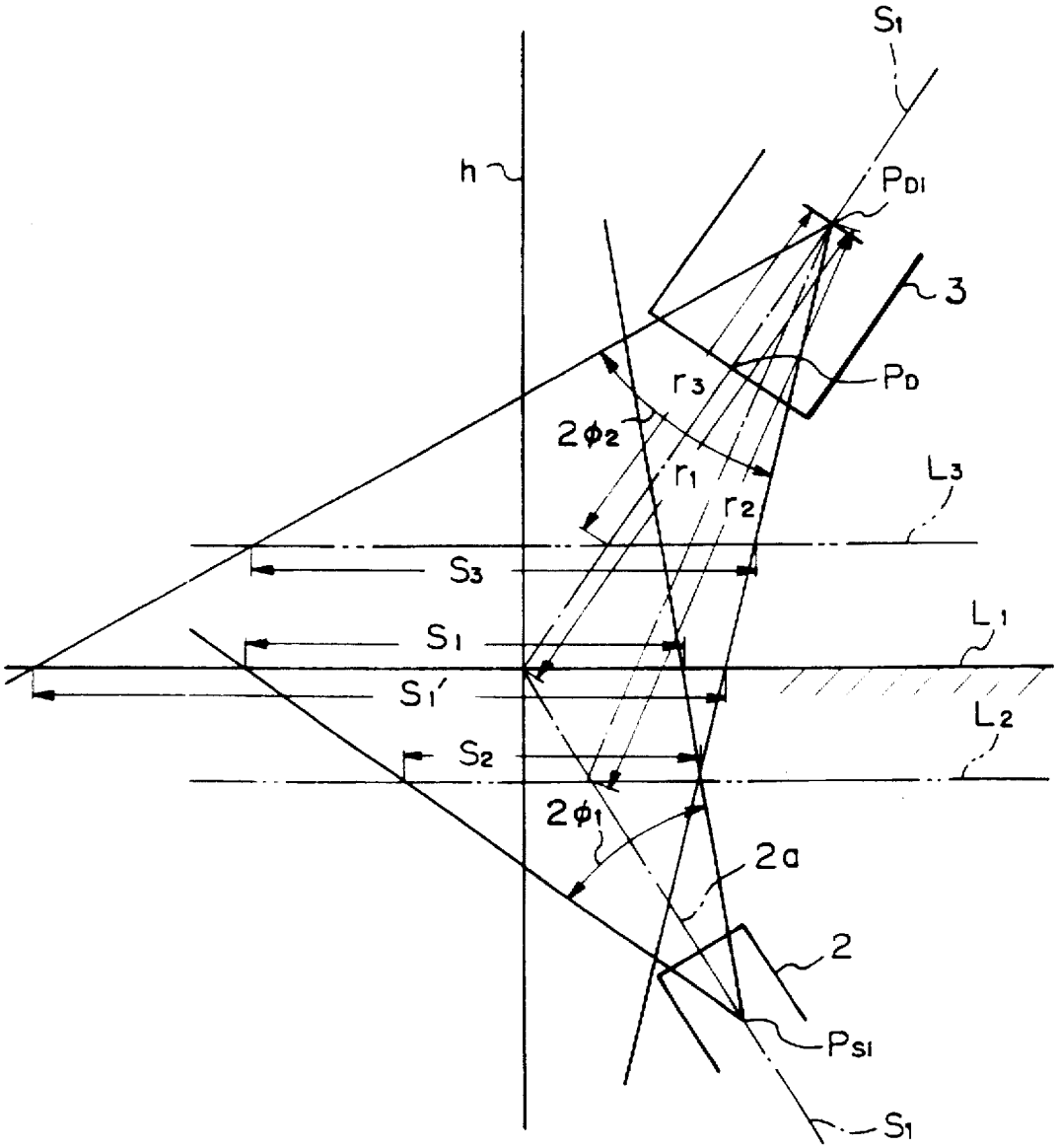
FIG. 12 shows a condition wherein the two elements inclined relative to the normal of the image carrier are assumed to be positioned symmetrically to each other with respect to the image forming surface of the image carrier, and the position of the image carrier is shifted.

As shown in FIG. 12, assume that the elements 2 and 3 have directivities $2\phi1$ and $2\phi2$, respectively, and that the quantity of light of the element 2 and the sensitivity of the element 3 are "1" at the inside of the spread of the directivities and "0" at the outside of the same. Assume that a surface L to be sensed, i.e., a reflecting surface L is shifted from a first position L1 to a second position L2. Then, the area of light which the element 3 receives from the surface L is reduced from the emission area SI of the element 2 particular to the position L1 to the emission area S2 of the element 2 particular to the position L2. The illumination in the emission area S2 is SI/S2 times as high as the illumination in the emission area S1. This is equal to a relation between a distance r1 between the position L1 and a point PDi where light is incident to the element 3 and a distance r2 between the position L2 and the point $P_{Di}$. As a result, the illumination on the surface to be sensed varies inversely proportionally to the square of the distance between the element 3 and the above surface:

$$\text{sensitivity of element 3} \propto (r1/r2)^2$$

Hence, when the surface to be sensed is shifted from L1 to L2, the device can accurately measure the toner density although the sensitivity of the element 3 to the incident light decreases. This is because the device causes the element 2 to emit light and causes the element 3 to read a change in the resulting reflection incident thereto.

Assume that the position or surface L1 to be sensed is shifted to a third surface L3, as also shown in FIG. 12. Then, the area of light which the element 3 receives from the surface to be sensed decreases from an emission area SI' to an emission area S3. The illumination in the emission area S3 is SI'/S3 times as high as the illumination in the emission area SI'. This is equal to a relation between the distance r1 between the surface L1 and the light receiving point $P_{Di}$ of the element 3 and a distance r3 between the surface L3 and the point $P_{Di}$. As a result, the illumination on the surface to be sensed varies inversely proportionally to the square of the distance between the element 3 and the above surface:

$$\text{sensitivity of element 3} \propto (r1/r3)^2$$

Although the above arrangement increases the sensitivity of the element 3 to light, the surface L3 diffuses the reflection therefrom even to the outside of the light-sensitive range of the element 3. Consequently, the light incident to the light-sensitive range of the element 3 decreases. However, the light receiving ability of the element 3 remains the same in the same manner as when the surface to be sensed is shifted to the surface L2.

Figure 13:
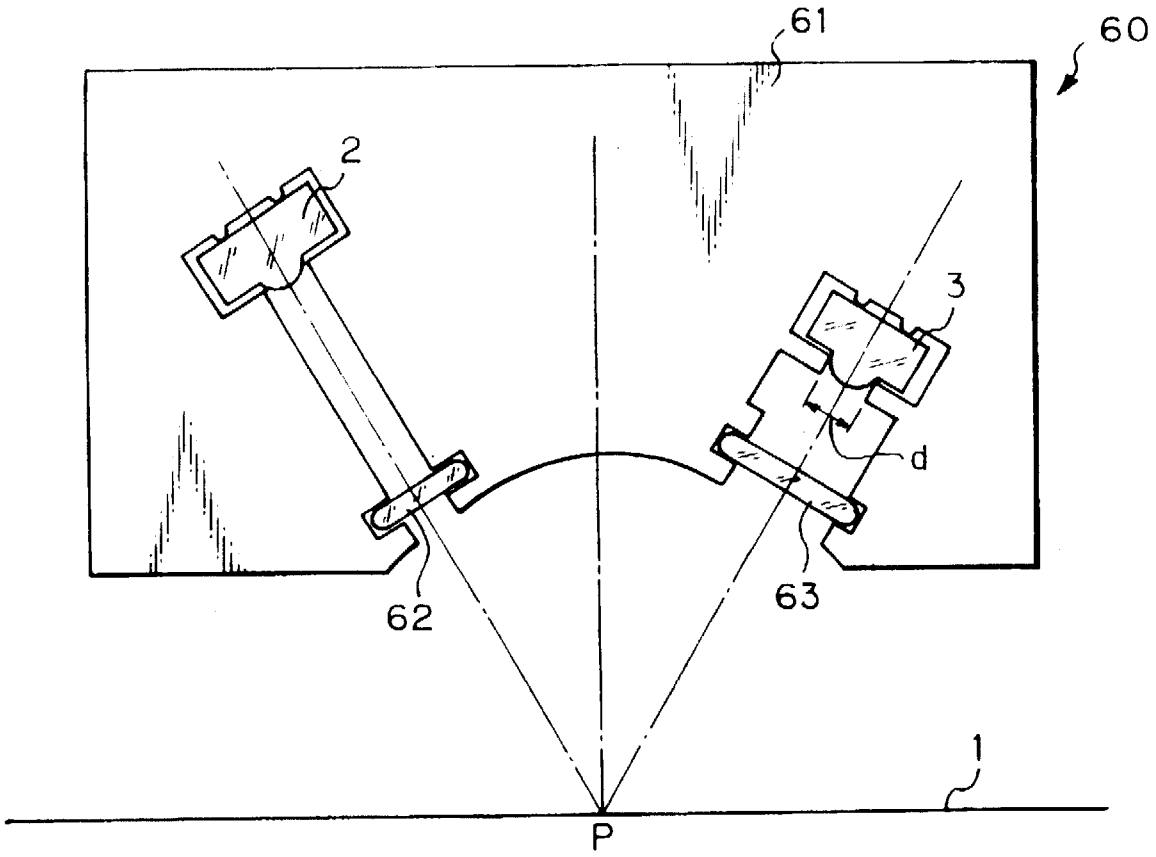
FIG. 13 is a side elevation of a sensor unit on which a light emitting element and a light receiving element constituting a fourth embodiment of the present invention are mounted.

Referring to FIGS. 13–19, a fourth embodiment of the present invention will be described. As shown in FIG. 13, the elements 2 and 3 are mounted on a support member 61 included in a sensor unit 60. A Fresnel lens 62 and a dustproof glass 63 are respectively positioned in front of the elements 2 and 3. The Fresnel lens or condensing element 62 is positioned such that a restricted beam output therefrom is incident to a point P on an image carrier 1. The beam spot at the point P is incident to the element 3 via the glass 63. The Fresnel lens 62 may be positioned in front of the element 3, if desired.

Figure 14:
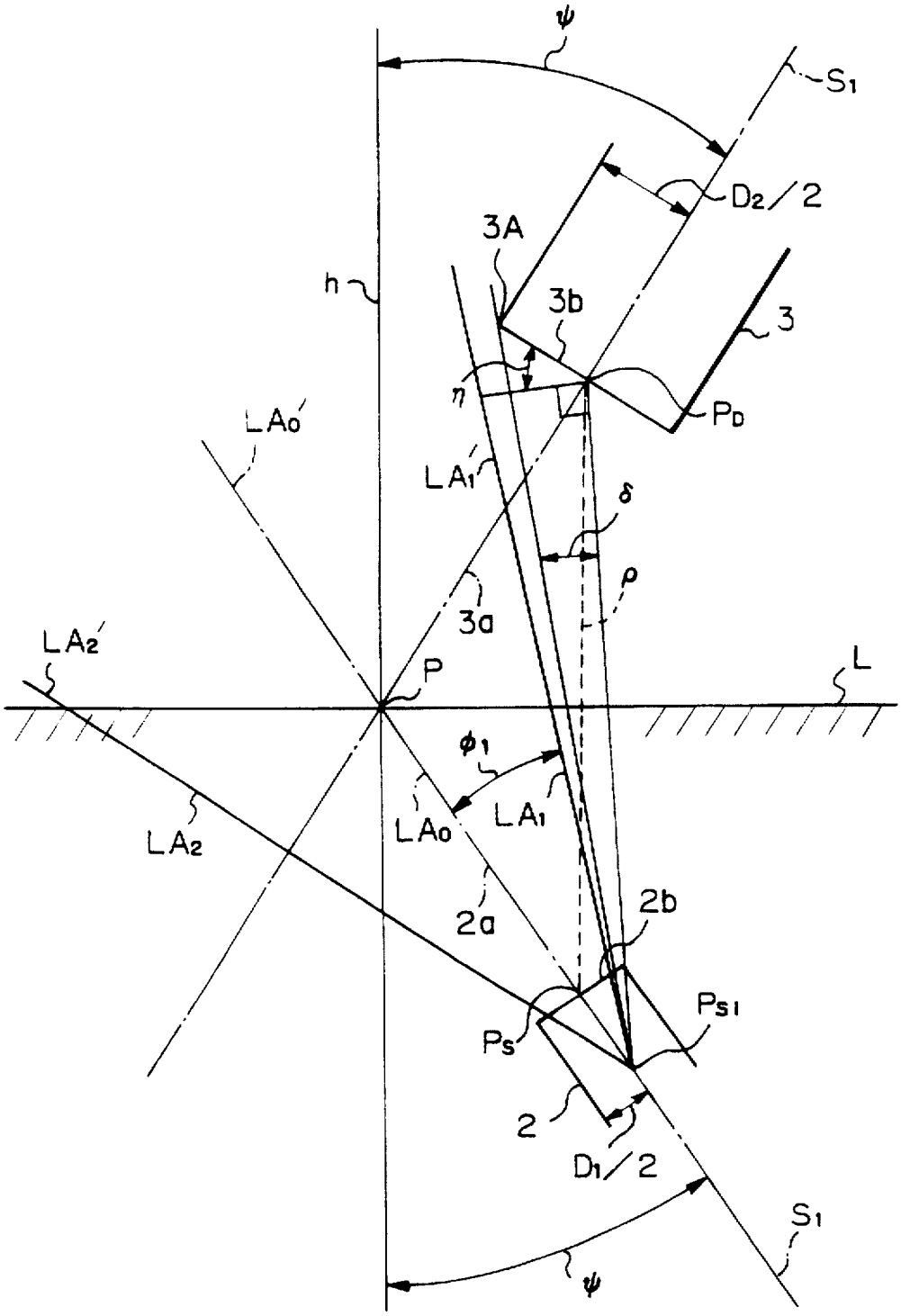
FIG. 14 shows a condition wherein the two elements of the fourth embodiment inclined relative to the normal of the image carrier are assumed to be positioned symmetrically to each other with respect to the image forming surface of the image carrier, for describing the inclination by using the light emitting element as a reference.

As shown in FIG. 14, assume that the elements 2 and 3 inclined relative to the normal of the image carrier 1 are positioned symmetrically to each other with respect to the image forming surface of the image carrier 1 to be sensed. There are shown in FIG. 14 a directivity $\phi1$ which is the spread of a beam issuing from the element 2, a directivity $\phi2$ particular to the element 3, a normal h extending through a point P where the axes 2*a* and 3*a* of the elements 2 and 3 intersect each other, an angle $\phi$ between the normal h and a plane S1 containing the axes 2*a* and 3*a*, a diameter D1 particular to the light emitting surface 2*b* of the element 2, and an optical path length $\rho$ between the center $P_S$ of the surface 2*b* and the center $P_D$ of the light receiving surface 3*b* of the element 3. The plane S1 is inclined relative to the normal h by the following angle $\phi$:

$$\phi > \phi1 + \tan^{-1}(D2/2\rho)$$

In this case, the light issuing from the element 2 and lying in the directivity $\phi1$ is one half of the light issuing along the optical axis of the element 2.

A relation between the intensity of light having the directivity $\phi1$ and the intensities of regular and diffused reflections is as follows. In FIG. 14, segments LA0, LA1 and LA2 extending from the center of emission $P_{Si}$ of the element 2 to the reflecting surface L are representative of light issuing from the element 2. Segments LA0', LA1' and LA2' which are respectively the extensions of the segments LA0, LA1 and LA2 and located at the element 3 side with respect to the surface L are representative of regular reflections from the surface L. The intensity of a regular reflection varies in proportion to the emission intensity distribution of a light emitting element, as well known in the art. On the other hand, the intensity of a diffused reflection is proportional to the solid angle of the light receiving surface of the element 3 as seen from the point P, as also well known in the art. It follows that if the light receiving surface of the element 3 has a constant size, and if the distance between the point P and the element 3 is constant, the intensity of the diffused reflection does not vary. In the zones on the segments LA1' and LA2' which are coincident with the zones having the directivity $\phi1$, the intensity of the regular reflection is one half of the intensity on the optical axis LA0' of the element 2 (most intense). Hence, if the light receiving surface of the element 3 is located outside of the range between the segments LA1' and LA2', the element 3 will sense only the regular reflection whose intensity is one half and will sense the diffused reflection without reducing its intensity.

The above relation also holds when the element 3 is used as a reference, as will be described later with reference to FIG. 15. Briefly, if the light emitting surface of the element 2 is positioned outside of the range of the element 3 having the directivity $\phi2$, the intensity of the regular reflection incident to the element 3 is reduced to one half or less while the intensity of the diffused reflection is not varied.

The optical path length $\rho$ between the elements 2 and 3 is the minimum distance over which light is propagated from the point $P_S$ of the optical axis of the element 2 to the point $P_D$ of the optical axis of the element 3 via the surface L. Generally, as to the directivity of the element 2, the center of emission $P_{Si}$ is positioned slightly inboard of the light emitting surface of the element 2. Therefore, the distance between the center of emission $P_{Si}$ to the point $P_D$ on the light receiving surface of the element 3 is greater than the distance between the point $P_S$ and the point $P_D$, i.e.:

$$\overline{P_{Si}P_D} > \overline{P_SP_D}$$

The center of the element 3 as seen from the center of emission $P_{Si}$ of the element 2 and the end 3A of the element 3 make an angle $\phi$ which satisfies the following relation:

$$\delta = \tan^{-1}\left(\frac{\frac{1}{2}D_2\cos\eta}{\overline{P_{Si}P_D}}\right) < \tan^{-1}\left(\frac{\frac{1}{2}D_2}{\overline{P_SP_D}}\right) = \tan^{-1}\left(\frac{D^2}{2\rho}\right)$$

where $D_2$ denotes the diameter of the light receiving surface of the element 3. For the above relation, use is made of cos $\eta \leqq 1$ and $\overline{P_{Si}P_D} > \overline{P_SP_D}$.

The element 3 has its light receiving surface positioned at the outside of the beam $\phi 1$ issuing from the element 2. Hence, the following relation holds:

$$\phi > \phi_1 + \tan^{-1}\left(\frac{D_2}{2\rho}\right)$$

If the plane S1 containing the optical axes 2*a* and 3*a* of the elements 2 and 3 is inclined relative to the normal h such that the angle $\phi$ satisfies the above relation, most of the regular reflection LA is emitted to the outside of the light receiving surface of the element 3, as shown in FIG. 14. This is also true with the element 3, as follows.

Figure 15:
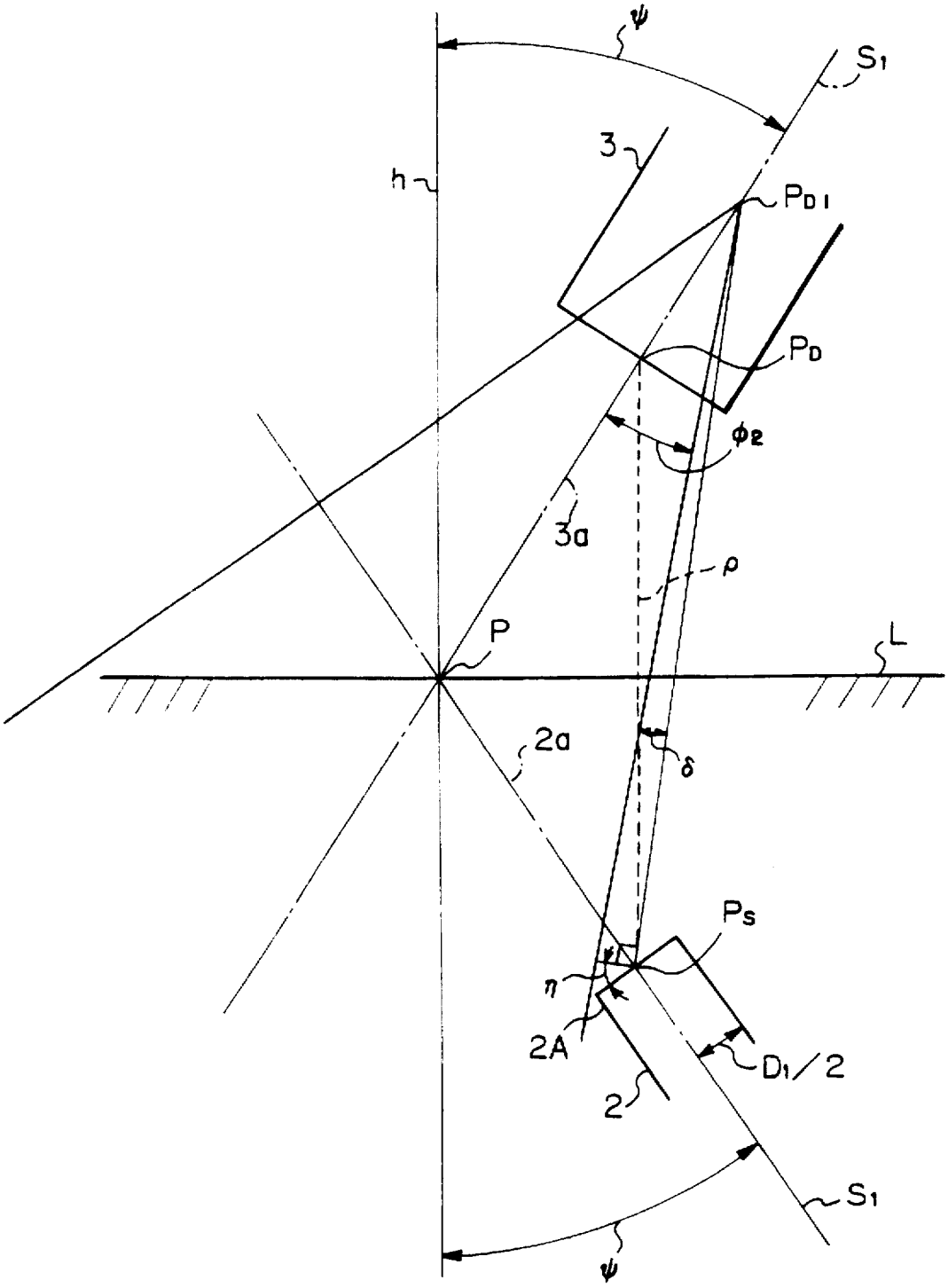
FIG. 15 is a view similar to FIG. 14 and for describing the inclination by using the light receiving element as a reference.

As shown in FIG. 15, the element 3 has the directivity or spread of incident light $\phi 2$ while the light emitting surface 2*b* of the element 2 has a diameter D1. In this case, the sensitivity of the element 3 to the light having the directivity $\phi 2$, as seen from the optical axis of the element 3, is one half of the sensitivity on the optical axis. The optical path length $\rho$ between the elements 2 and 3 is the minimum distance over which light is propagated from the point $P_D$ of the optical axis of the element 3 to the point $P_S$ of the optical axis of the element 2 via the surface L. Generally, as to the directivity of the element 3, the center of incidence $P_{Di}$ is positioned slightly inboard of the light receiving surface of the element 3. Therefore, the distance between the center of emission $P_S$ to the point $P_D$ on the light receiving surface is greater than the distance between the point $P_{Di}$ and the point $P_S$, i.e.:

$$\overline{P_{Di}P_S} > \overline{P_SP_D}$$

The point $P_S$ on the light emitting surface of the element 3, as seen from the center $P_{Di}$ of the element 3, and the end 2A of the element 2 on the normal h side make an angle $\delta$ which satisfies the following relation:

$$\delta = \tan^{-1}\left(\frac{\frac{1}{2}D_1\cos\eta}{\overline{P_{Di}P_S}}\right) < \tan^{-1}\left(\frac{\frac{1}{2}D_1}{\overline{P_SP_D}}\right) = \tan^{-1}\left(\frac{D_1}{2\rho}\right)$$

For the above relation, use is made of cos $\eta \leqq 1$ and $\overline{P_{Di}P_D} > \overline{P_SP_D}$.

The element 2 has its light emitting surface positioned at the outside of the beam $\phi 2$ incident to the element 3. Hence, the following relation holds:

$$\phi > \phi_2 + \tan^{-1}\left(\frac{D_1}{2\rho}\right)$$

If the plane S1 containing the optical axes 2*a* and 3*a* of the elements 2 and 3 is inclined relative to the normal h such that the angle $\phi$ satisfies the above relation, most of the regular reflection LA is emitted to the outside of the light receiving surface of the element 3, as shown in FIG. 15.

As stated above, the light receiving surface of the element 3 is positioned at the outside of the beam $\phi 1$ issuing from the element, or the light emitting surface of the element 2 is positioned at the outside of the beam $\phi 2$ incident to the element 3. That is, the element 2 or 3 is so positioned as to satisfy either one of the following relations:

$$\phi > \phi_1 + \tan^{-1}\left(\frac{D_2}{2\rho}\right)$$

$$\phi > \phi_2 + \tan^{-1}\left(\frac{D_1}{2\rho}\right)$$

In the above condition, the element 3 receives the diffused reflection without receiving most of the regular reflection. Hence, the element 3 can accurately sense the amount of color toner deposition without being disturbed by noise ascribable to the regular reflection.

Figure 16:
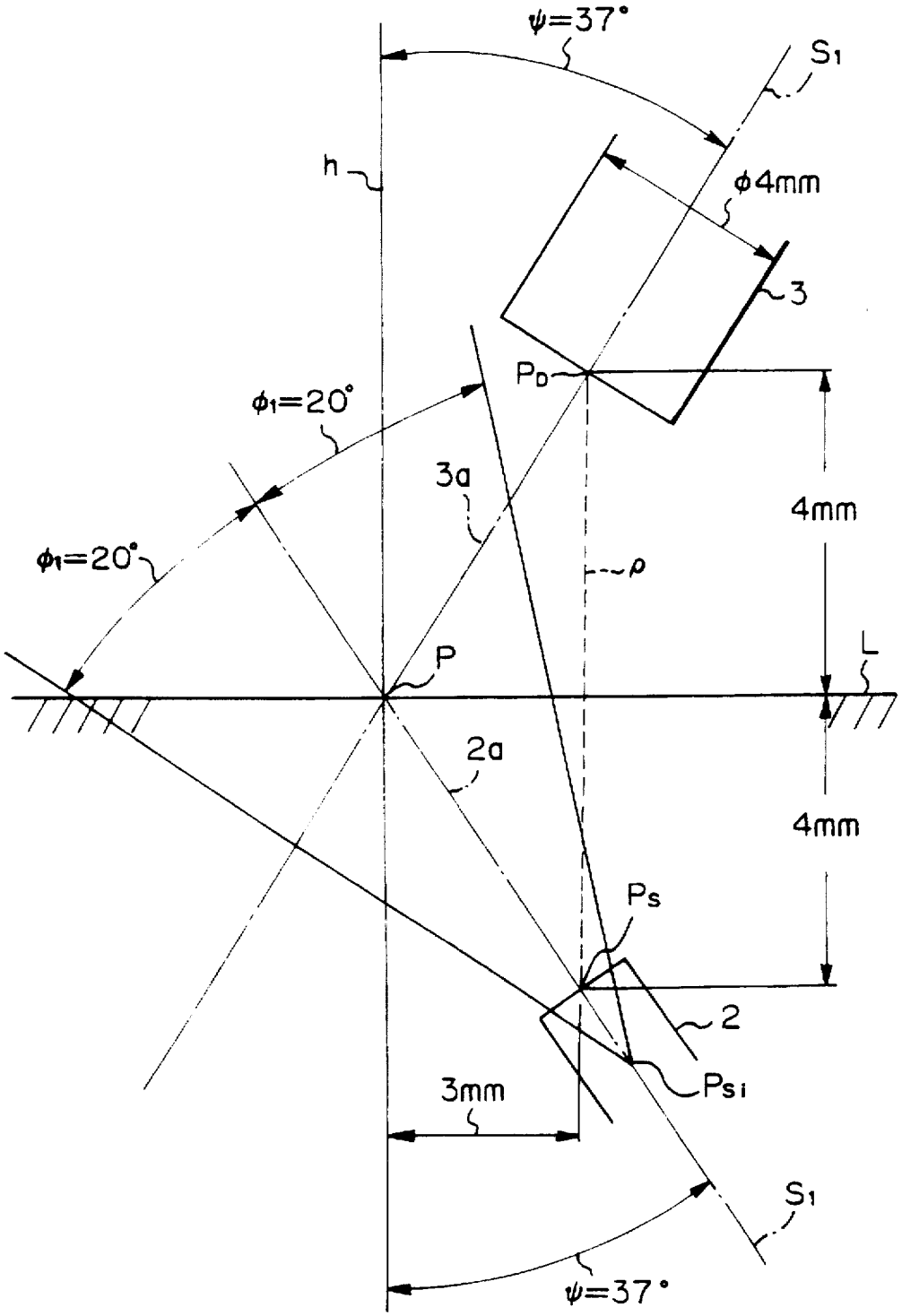
FIG. 16 shows specific numerical values given to the two elements of the fourth embodiment.

FIG. 16 shows a specific arrangement of the illustrative embodiment. As shown, the element 3 has a light receiving area or diameter of 4 mm while the element 2 has a directivity $\phi 1$ of 20 degrees. The elements 2 and 3 are each spaced 4 mm from the surface L to be sensed; that is, the distance $\rho$ between the center of the light emitting surface of the element 2 and the center of the light receiving surface of the element 3 is 8 mm. The angle $\phi$ that prevents most of the regular reflection from the surface L from being incident to the element 3 is produced by:

$$\delta = \tan^{-1}\left(\frac{\frac{1}{2}D_2\cos\eta}{\overline{P_{Si}P_D}}\right) < \tan^{-1}\left(\frac{\frac{1}{2}D_2}{\overline{P_SP_D}}\right) = \tan^{-1}\left(\frac{D_2}{2\rho}\right)$$

By substituting actual numerical values for the above equation, there is produced:

$$\tan^{-1}\frac{D_2}{2\rho} = \tan^{-1}\frac{\frac{2}{4}}{8} = 14°$$

By substituting the above value for $\phi 1 + \tan^{-1}(D2/2\rho)$, there holds:

$$\phi 1 + \tan^{-1}\frac{D_2}{2\rho} = (20 + 14)$$

As a result, the above angle $\phi$ is determined to be 34 degrees.

Assume that the plane S1 containing the optical axes 2*a* and 3*a* is inclined relative to the normal h by the following angle $\phi$:

$$\phi' = \tan^{-1}\frac{3}{4} \neq 37°$$

The actual angle $\phi'$ of 37 degrees is greater than the angle $\phi$ of 34 degrees which prevents most of the regular reflection from being incident to the element 3. This allows the sensor to sense the toner density without being disturbed by the regular reflection or noise.

Figure 17:
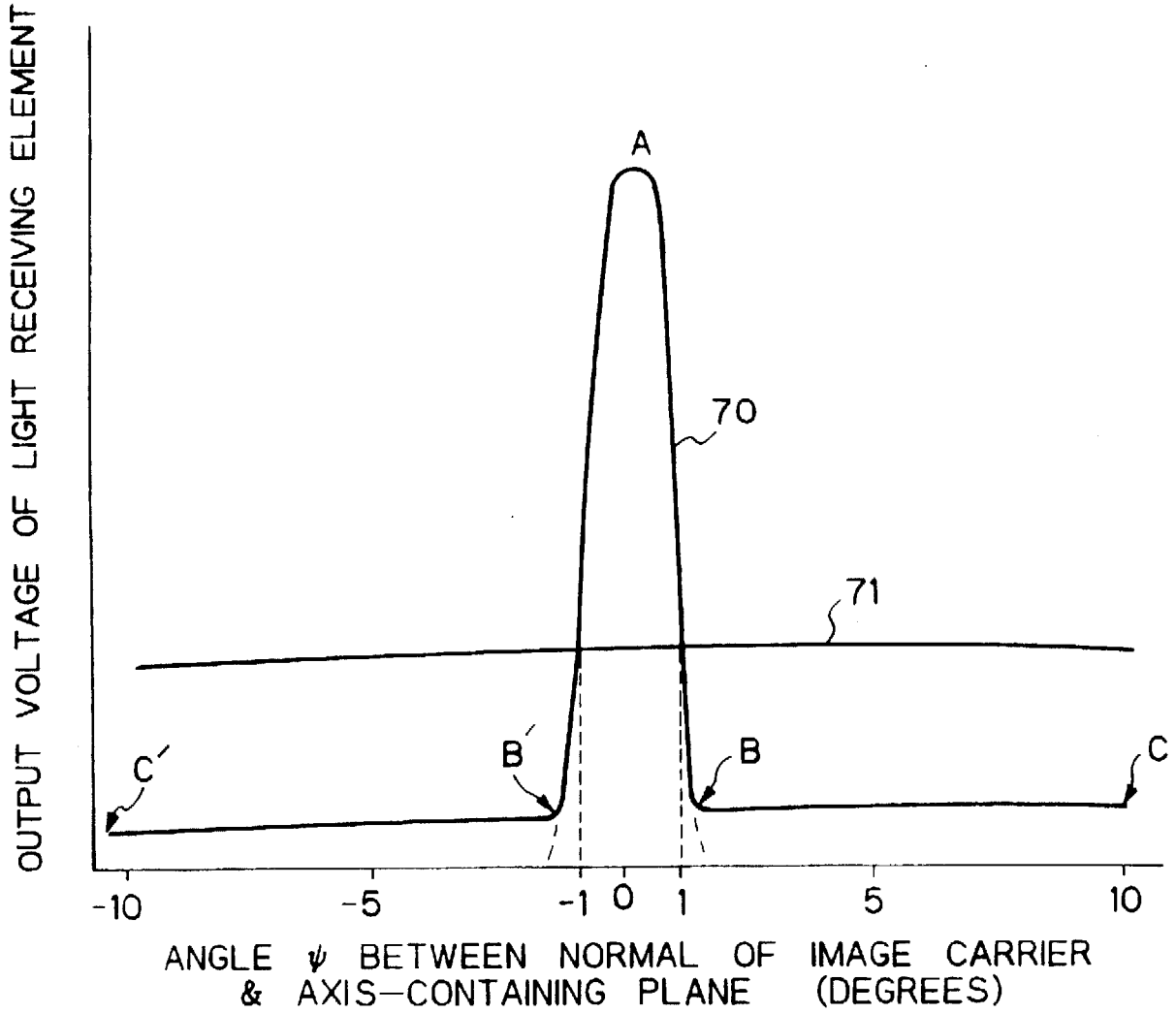
FIG. 17 shows a relation between the angle of the sensor to the surface of the image carrier and the output voltage of the sensor, and occurring when the two elements have narrow directivities.

Assume that the directivity $\phi 1$ of the element 2 is as narrow as 2 degrees by way of example. FIG. 17 shows a relation between the angle $\phi$ between the normal h shown in FIGS. 13–15 and the output voltage of the sensor including the above element 2. In FIG. 17, the directivity $\phi 2$ of the element 3 is assumed to be 30 degrees. A curve 70 indicates the sensor output to appear when the toner is absent on the image carrier 1; the sensor is capable of sensing mainly the regular reflection from the image carrier 1 in a range B'AB, and capable of sensing only the diffused reflection in ranges C'B' and BC. A curve 71 indicates the sensor output to appear when the toner is deposited on the entire surface of the image carrier 1; it is scarcely dependent on the angle $\phi$. This is also true with the diffused reflection when the toner is absent on the image carrier 1.

Figure 18:
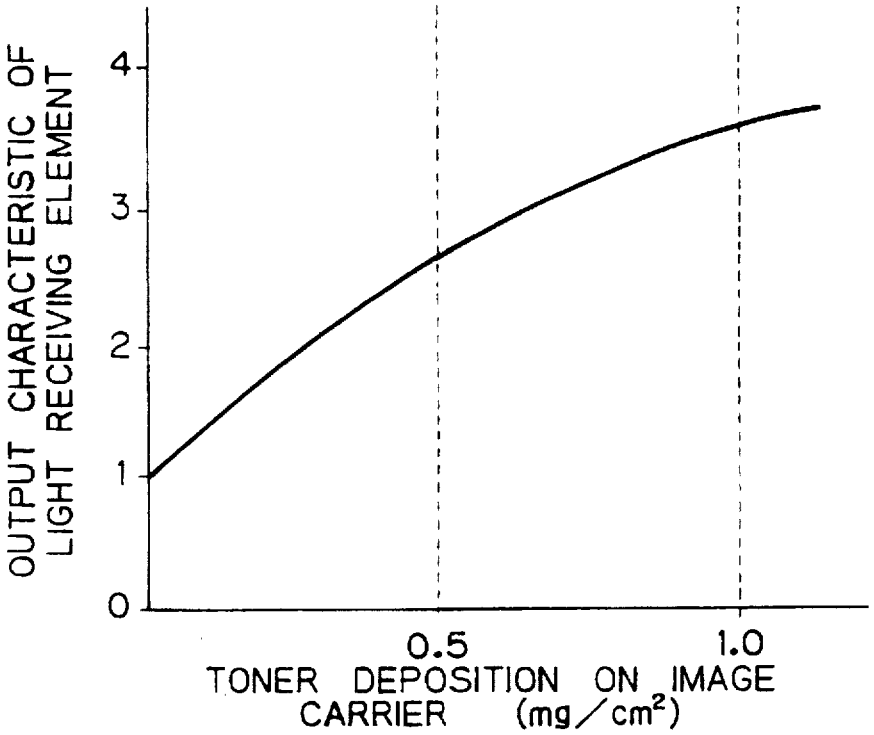
FIG. 18 shows a relation between the amount of toner deposition and the output voltage of the light receiving element to occur when the plane containing the optical axes of the two elements is inclined by an angle $\phi$ to the normal.

In FIG. 17, at and around the angle $\phi$ of zero degree, the sensor output noticeably varies without regard to the degree of toner deposition. However, as shown in FIG. 8, the angle $\phi$ of zero degree prevents the sensor output from noticeably varying even when the amount of toner deposited on the image carrier 1 varies. By contrast, when the plane S1 containing the optical axes 2*a* and 3*a* is inclined by the angle $\phi$ greater than ±1 degree relative to the normal h, the sensor achieves sufficient sensitivity even in the range where the amount of toner deposition is great, as shown in FIG. 18. Hence, by inclining the elements 2 and 3 by the angle $\phi$ greater than ±1 degree, i.e. by 2 degrees in the embodiment, it is possible to sense the amount of toner deposition with high sensitivity while obviating the influence of the regular reflection or noise.

The output characteristic of the element 3 is dependent on the difference in directivity between the elements 2 and 3. When the elements 2 and 3 have relatively board directivities e.g., $\phi 1$ and $\phi 2$, e.g., 30 degrees and 20 degrees, respectively, the output of the element 3 varies in relation to the angle $\phi$, as shown in FIG. 4. FIG. 7 shows the variation of the output of the element 3 to occur when the directivities $\phi 1$ and $\phi 2$ of the elements 2 and 3 are medium, e.g., 8 degrees and 12 degrees, respectively. Further, FIG. 17 shows the variation of the output of the element 3 to occur when one of the directivities $\phi 1$ and $\phi 2$ is narrow, e.g., when the directivity $\phi 1$ is 2 degrees.

In summary, it will be seen that the present invention provides a sensor capable of excluding noise attributable to a regular reflection from a color toner which is deposited on an image carrier and diffuses incident light, thereby sensing color toner density with accuracy. Moreover, the sensor is surely operable only if a plane containing the optical axis of a light emitting element and that of a light receiving element is inclined relative to a normal. This eliminates the need for the conventional electrical implementation for processing the result of sensing. In addition, the sensor condenses light issuing from the light emitting element or light incident to the light receiving element, thereby enhancing the sensing accuracy.

Various modifications will become possible for those skilled in the art after receiving the teachings of the present disclosure without departing from the scope thereof.

What is claimed is:

1. An image forming apparatus, comprising:

a toner density sensor including a light emitting element which emits light toward a toner pattern image formed on an image carrier, and a light receiving element which receives a resulting reflection from said toner pattern image in order to allow an image forming condition to be controlled based on an output of said light receiving element, said light emitting element and said light receiving element positioned such that a line connecting said light emitting element and said toner pattern image and a line connecting said light receiving element and said toner pattern image lie in a plane inclined a preselected angle relative to a normal extending from a surface of said image carrier through said toner pattern image.

2. The apparatus as claimed in claim 1, further comprising:

a support element on which said light emitting element and said light receiving element are mounted to form a unit.

3. The apparatus as claimed in claim 1, wherein:

said light emitting element and said light receiving element each has a directivity, and said light emitting element and said light receiving element are positioned to satisfy either one of the following relations:

$$\phi > \phi 1 + \tan^{-1}(D2/2\rho)$$

$$\phi > \phi 2 + \tan^{-1}(D1/2\rho)$$

where $\phi 1$ is the directivity or spread of a beam issuing from said light emitting element, $\phi 2$ is the directivity or spread of a beam incident to said light receiving element, $\phi$ is the preselected angle, D1 is a diameter of a light emitting surface of said light emitting element, D2 is a diameter of a light receiving surface of said light receiving element, and $\rho$ is an optical path length between a center of said light emitting surface and a center of said light receiving surface.

4. The apparatus as claimed in claim 1, further comprising:

a support element on which said light emitting element and said light receiving element are mounted to form a unit.

5. A toner density sensor, comprising:

a light emitting element which emits light toward a toner pattern image formed on an image carrier, and a light receiving element which receives a resulting reflection from said toner pattern image in order to allow an image forming condition to be controlled based on an output of said light receiving element, wherein said light emitting element and said light receiving element are positioned such that a line connecting said light emitting element and said toner pattern image and a line connecting said light receiving element and said toner pattern image lie in a plane inclined a preselected angle relative to a normal extending from a surface of said image carrier through said toner pattern image.

6. The toner density sensor as claimed in claim 5, further comprising:

a support element on which said light emitting element and said light receiving element are mounted to form a unit.

7. The toner density sensor as claimed in claim 5, wherein:

said light emitting element and said light receiving element each has a directivity, and said light emitting element and said light receiving element are positioned to satisfy either one of the following relations:

$$\phi > \phi 1 + \tan^{-1}(D2/2\rho)$$

$$\phi > \phi 2 + \tan^{-1}(D1/2\rho)$$

where $\phi 1$ is the directivity of spread of a beam issuing from said light emitting element, $\phi 2$ is the directivity or spread of a beam incident to said light receiving element, $\phi$ is the preselected angle, D1 is a diameter of a light emitting surface of said light emitting element, D2 is a diameter of a light receiving surface of said light receiving element, and $\rho$ is an optical path length between a center of said light emitting surface and a center of said light receiving surface.

8. The apparatus as claimed in claim 7, comprising:

a support element on which said light emitting element and said light receiving element are mounted to form a unit.

9. An image forming apparatus, comprising:

a toner density sensor including a light emitting element which emits light toward a toner pattern image formed on an image carrier, and a light receiving element which receives a resulting reflection from said toner pattern image in order to allow an image forming condition to be controlled based on an output of said light receiving element, said light emitting element and said light receiving element are positioned such that a line connecting said light emitting element and said toner pattern image and a line connecting said light receiving element and said toner pattern image are inclined at a preselected angle relative to a normal extending from a surface of said image carrier through said toner pattern image.

10. The apparatus as claimed in claim 9, wherein:

said light emitting element and said light receiving element each has a directivity, and said light emitting element and said light receiving element are positioned to satisfy either one of the following relations:

$$\phi > \phi 1 + \tan^{-1}(D2/2\rho)$$

$$\phi > \phi 2 + \tan^{-1}(D1/2\rho)$$

where $\phi 1$ is the directivity or spread of a beam issuing from said light emitting element, $\phi 2$ is the directivity or spread of a beam incident to said light receiving element, $\phi$ is the preselected angle, D1 is a diameter of a light emitting surface of said light emitting element, D2 is a diameter of a light receiving surface of said light receiving element, and $\rho$ is an optical path length between a center of said light emitting surface and a center of said light receiving surface.

11. A toner density sensor comprising:

a light emitting element for emitting light toward a toner pattern image formed on an image carrier, and a light receiving element for receiving a resulting reflection from said toner pattern image in order to allow an image forming condition to be controlled based on an output of said light receiving element, said light emitting element and said light receiving element are positioned such that a line connecting said light emitting element and said toner pattern image and a line connecting said light receiving element and said toner pattern image are inclined a preselected angle relative to a normal extending from a surface of said image carrier through said toner pattern image.

12. The toner density sensor as claimed in claim 11, wherein:

said light emitting element and said light receiving element each has a directivity, and said light emitting element and said light receiving element are positioned to satisfy either one of the following relations:

$$\phi > \phi 1 + \tan^{-1}(D2/2\rho)$$

$$\phi > \phi 2 + \tan^{-1}(D1/2\rho)$$

where $\phi 1$ is the directivity or spread of a beam issuing from said light emitting element, $\phi 2$ is the directivity or spread of a beam incident to said light receiving element, $\phi$ is the preselected angle, D1 is a diameter of a light emitting surface of said light emitting element, D2 is a diameter of a light receiving surface of said light receiving element, and $\rho$ is an optical path length between a center of said light emitting surface and a center of said light receiving surface.

13. A toner density sensing method, comprising the steps of:

positioning a light emitting element and a light receiving element such that a line connecting said light emitting element and a toner pattern image formed on an image carrier and a line connecting said light receiving element and said toner pattern image lie in a plane inclined a preselected angle relative to a normal extending from a surface of said image carrier through said toner pattern image;

emitting light from said light emitting element toward said toner pattern image, receiving a resulting reflection from said toner pattern image with a light receiving element, and controlling an image forming condition based on an output of said light receiving element.

14. The method according to claim 13, further comprising the steps of:

positioning said light emitting element such that a line connecting said light emitting element and said toner pattern image is inclined a first predetermined angle relative to a normal extending from a surface of said image carrier through said toner pattern image; and causing the reflection to be incident to said light receiving element positioned such that a line connecting said light receiving element and said toner pattern image is inclined at a second predetermined angle relative to said normal.

* * * * *